US007264342B2

(12) United States Patent
Yamamoto et al.

(10) Patent No.: US 7,264,342 B2
(45) Date of Patent: Sep. 4, 2007

(54) LIQUID CONTAINER AND PRINTING APPARATUS USING THE SAME

(75) Inventors: Hajime Yamamoto, Tokyo (JP); Nobuyuki Hatasa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 11/136,515

(22) Filed: May 25, 2005

(65) Prior Publication Data

US 2005/0270341 A1 Dec. 8, 2005

(30) Foreign Application Priority Data

Jun. 2, 2004 (JP) ..... 2004/164548

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS

| | | | | |
|---|---|---|---|---|
| 5,509,140 | A | 4/1996 | Koitabashi et al. | 347/86 |
| 5,742,312 | A | 4/1998 | Carlotta | 347/87 |
| 5,875,615 | A * | 3/1999 | Ito et al. | 53/474 |
| 5,903,294 | A * | 5/1999 | Abe et al. | 347/87 |
| 6,058,984 | A * | 5/2000 | Sato | 141/7 |
| 6,095,642 | A | 8/2000 | Koitabashi et al. | 347/86 |
| 6,145,972 | A * | 11/2000 | Udagawa et al. | 347/86 |
| 6,419,349 | B1 | 7/2002 | Iwanaga et al. | 347/86 |
| 6,505,923 | B1 | 1/2003 | Yamamoto et al. | 347/85 |
| 2003/0020791 | A1 | 1/2003 | Higuma et al. | 347/86 |
| 2003/0048337 | A1 | 3/2003 | Jones et al. | 347/86 |
| 2004/0160496 | A1 | 8/2004 | Tsurui et al. | 347/86 |
| 2005/0270315 | A1 | 12/2005 | Yamamoto | 347/7 |
| 2005/0270347 | A1 | 12/2005 | Yamamoto | 347/86 |
| 2005/0275698 | A1 | 12/2005 | Noguchi et al. | 347/85 |
| 2006/0139422 | A1 | 6/2006 | Hatasa et al. | |

FOREIGN PATENT DOCUMENTS

| | | |
|---|---|---|
| EP | 803364 | 10/1997 |
| EP | 834401 | 4/1998 |
| GB | 2315462 | 2/1998 |
| JP | 2951818 | 7/1999 |
| JP | 2001-270131 | 10/2001 |
| JP | 2005-7855 | 1/2005 |

* cited by examiner

*Primary Examiner*—Anh T. N. Vo
(74) *Attorney, Agent, or Firm*—Fitzpatrick, Cella, Harper & Scinto

(57) ABSTRACT

An intermediate chamber 7 is provided in a liquid storage chamber 6 of a liquid container 1, for separating the liquid storage chamber 6 from a chamber 5 for accommodating a negative pressure generating member. The intermediate chamber 7 communicates with both of the liquid storage chamber 6 and the chamber 5 for accommodating the negative pressure generating member, and further communicates with the liquid storage chamber 6 via a plurality of small openings 18 provided upward from the bottom thereof.

8 Claims, 12 Drawing Sheets

LIQUID CONTAINER AND PRINTING APPARATUS USING THE SAME

FIELD OF THE INVENTION

The present invention relates to a liquid container mounted to an ink-jet printing apparatus and a printing apparatus using the same.

DESCRIPTION OF THE RELATED ART

Generally, an ink cartridge used as a liquid container in a field of the ink-jet printing is provided with a structure for adjusting an inner pressure of ink of the ink cartridge for performing well the ink supply to a printing head for ejecting ink. The negative pressure of the ink cartridge can be generated for retaining a meniscus formed in an ink-ejecting section of the printing head by providing a negative generating member in the ink cartridge.

Recently, the ink-jet printing technology has been significantly developed, and thus photorealistic print have easily been obtainable. However, in comparison with a silver-salt photography, since the durability of the print (such as light resistance or gas-resistance) is inferior to that in the silver-salt photography, there has been the user's requirement for the improvement thereof. One of the countermeasures to such a requirement is the employment of pigment ink. The pigment ink is the scattering of insoluble pigment colorant in an ink solvent wherein a specific gravity of the pigment colorant is larger than that of the ink solvent. Accordingly, even if the pigment colorant is uniformly dispersed during the production of the ink, the settling phenomenon of pigment particles is unavoidable over time.

As a liquid container simple in structure and widely used in this field, in one aspect, a foam or a fibrous confounding body is accommodated in a housing of the liquid container so that ink is impregnated and retained in the foam or fibrous confounding body. The ink in the foam or the fibrous confounding body in such an aspect has a very slow settling speed of pigment particles. And, the pigment ink in the foam or the fibrous confounding body in such a structure is made available provided the ink capacity and the usage period are suitably determined.

On the other hand, the present applicant has proposed a liquid container with a liquid storage room, for example, in the Japanese Patent Publication No. 2951818, having a large ink capacity per unit volume of the liquid container as well as resulting in a stable ink supply while using a negative pressure generating member for ink.

FIG. 10A illustrates a schematic sectional view of a liquid container of the above-mentioned structure. The interior of the liquid container 1 is divided into two spaces by a partition wall 14 having a communicating portion 9. One of the spaces forms a liquid storage chamber 6 tightly closed for accommodating directly ink except for a communicating portion 9 of the partition wall 14. The other space forms a chamber 5 for accommodating a negative generating member 11 and impregnating and retaining the liquid in the negative pressure generating member 11. In a wall forming this chamber 5 for accommodating the negative pressure generating member, there are an atmospheric communicating port 8 for introducing outside air into the interior of the liquid container 1 in accordance with the consumption of ink and an ink supply port 10 for supplying the liquid to a printing head portion (not shown). In this regard, in FIG. 10A, a region wherein the negative pressure generating member 11 retains the liquid is shown by dense oblique lines, and the ink stored in a space of the liquid storage chamber 6 is shown by broken lines.

According to the above-mentioned structure, as the ink in the negative pressure generating member 11 has been consumed by the printing head not shown, the liquid surface in the negative pressure generating member lowers and finally reaches an upper end of a gas-liquid exchange groove 19 referred to as groove. Thereafter, outside air is introduced into the chamber 5 for accommodating the negative pressure generating member from the atmospheric communicating port 8 as the ink has been consumed, and further enter the liquid storage chamber 6 through the communicating portion 9 of the partition wall 14. Instead, the ink in the liquid storage chamber 6 is filled in the negative pressure generating member 11 in the chamber 5 for accommodating the negative pressure generating member through the communicating portion 9 (hereinafter, referred to as the gas-liquid exchange operation). Accordingly, even if the ink has been consumed by the printing head, the ink is filled in the negative pressure generating member 11 in accordance with the consumed amount thereof whereby the negative pressure generating member 11 can maintain a constant amount of ink. Since the above-mentioned negative pressure relative to the printing head can be maintained at a generally constant value thereby, the ink supply to the printing head is stabilized. Such liquid containers combining small in size with high usability have been produced by the present applicant and are made available nowadays.

In the example shown in FIG. 10A, a space (a buffer chamber) 25 having no negative pressure generating member 11 is provided in the vicinity of the atmospheric communicating port 8 by ribs 24.

When the ink in the liquid storage chamber wherein the liquid is directly accommodated in such a manner has not been used for a long time, the pigment colorant thereof continues the settling phenomenon at a relatively high speed, whereby the concentration of the upper region of ink in the liquid storage chamber becomes gradually low and an area thereof widens downward. Contrarily, in the vicinity of the bottom of the liquid storage chamber, the concentration of the pigment gradually increases and an area thereof widens upward.

On the one hand, the pigment colorant of the pigment ink maintained by the negative pressure generating member 11 continues the settling phenomenon at a relatively lower speed. Thus, concentration difference of the pigment colorant in the chamber 15 for accommodating the negative pressure generating member becomes lower.

FIG. 10B schematically illustrates a liquid container which has been used at near the beginning on a printer but left unused in a use position as it is for a long time. In the distribution of ink 15 concentration in the liquid storage chamber, there are an area 15*b* wherein the ink concentration is proper, an area 15*a* wherein the pigment particles settles downward in the liquid container to result in the low ink concentration and an area 15*c* wherein the ink concentration increases due to the pigment particles settling from the upper areas.

On one hand, in the negative pressure generating member 11, there are an area 23*b* having a proper ink concentration, an area 23*a* having a low ink concentration and an area 23*c* having a high ink concentration although the difference between the three areas is slight in comparison with that in the liquid storage chamber 6. In an area in the drawing indicated by 11*e*, no ink is retained in the negative pressure generating member 11. An ink delivery member 12 provided in the ink supply port 10 directly communicates with the relatively thick concentration area 23*c* of the pigment colorant concentration in the negative pressure generating member 11. Also, the communicating portion 9 beneath the partition wall 14 for separating the liquid storage chamber 6 communicates with the considerably dense concentration area 15*c* of the pigment colorant concentration in the chamber 6. The magnitude relationship in the pigment concentration between the respective areas (although roughly divided into three areas, the respective area does not always maintain the same concentration but has a distribution of the concentration therein) is simply represented by the following formula:

Area 15*a*<area 23*a*<area 15*b*=area 23*b*<area 23*c*<area 15*c*

When the above-mentioned liquid container is made available to be mounted as an on-carriage tank on a serial scanning type printer wherein the printing is carried out while moving the ink tank together with a printing head in the widthwise direction of a printing paper, it has been know that the ink 15 in the liquid container 6 stirs by the motion of a carriage on which is mounted the liquid container, whereby the pigment does not readily settle, or even if the significant settling phenomenon has occurred due to the long term non-use (a stationary state), the inks in the areas 15*a*, 15*b* and 15*c* are mixed together by the stirring effect to restore to the initial state.

According to a liquid storage tank disclosed in Japanese Patent Application Laid-open No. 2005-007855, as shown in FIG. 11, the interior of the liquid container 1000 is completely filled with pigment ink, whereby there is no negative pressure generating member therein. Since there is no negative pressure generating member in the interior of the liquid container 1000, the pigment colorant is easily settled. If the liquid container 1000 has not been used for a long period, a low concentration layer 601, an intermediate concentration layer 602 and a high concentration layer 603 are generated. To improve such a concentration distribution, a pipe having a plurality of through-holes 107 is disposed in the liquid container wherein through-holes 107*a* for the high concentration layer has a smaller diameter and those 107*g* for the low concentration layer has a larger diameter so that the pigment concentration in the pipe becomes uniform; that is, proper, after which the ink of a proper concentration is supplied to a printing head 524 via a supply needle.

According to a liquid container disclosed in Japanese Patent Application Laid-open No. 2001-270131, as shown in FIG. 12, the interior of the liquid container 1 is filled with a negative pressure generating member 3 retaining pigment ink. Since no ink exists alone in the interior of the liquid container 1, the settling of the pigment colorant becomes relatively less. However, if the non-used state continues for a long period, the settling of the pigment colorant occurs. To improve such an concentration distribution in the liquid container 1, a pipe 4 having a plurality of through-holes 5 is disposed in the negative pressure generating member 3 so that the ink concentration distribution in the pipe 4 becomes uniform, after which the ink existing alone in the pipe 4 is supplied to a printing head.

SUMMARY OF THE INVENTION

However, it was found that the liquid container provided with the above-mentioned liquid storage chamber for directly accommodating ink and the chamber for accommodating the negative pressure generating member retaining ink has a significant problem. This is because the ink is supplied to the printing head from the liquid storage chamber 6 wherein the pigment colorant of the ink stored therein readily settles to accommodate directly ink and relatively easily returns, via the negative pressure generating member of the chamber 5 for accommodating the negative pressure generating member wherein the pigment colorant of the ink is difficult to settle and return.

Suppose that the purging operation for starting the printer or a very small amount of printing is carried out in a state wherein the pigment colorant settles in the liquid storage chamber during long quiescent operation of the printer as shown in FIG. 10B. When the ink in the area 15*c* having a high pigment concentration moves into the negative pressure generating member 11 via the communicating portion 9 without the application of sufficient stirring force respect to ink in the liquid storage chamber. It is not enough to substantially eliminate the settling of pigment colorant of the ink if the liquid container 1 is simply stirred on the carriage.

In addition, if a long term non-used state continues again thereafter, further the pigment colorant settling occurs due to supply ink to the printing head via the negative pressure generating member which the pigment colorant settling of the ink is difficult to return.

When the ink having a high pigment concentration is supplied from the negative pressure generating member to the printing head to carry out the printing operation, there is a problem that not only the print quality is largely damaged but also the ink is not normally ejected from the printing head for the reason that dispersed pigment particles begin to coagulate with each other, resulting in the clogging of a nozzle in the printing head.

The present invention has been made to eliminate the above-mentioned problem, and an object thereof is to provide a liquid container using a the gas-liquid exchange operation, having the liquid storage chamber for directly accommodating ink and the chamber for accommodating the negative pressure generating member retaining ink simple in structure with a high storage efficiency by taking account of a settling characteristic inherent to dispersed pigment.

In other words, a reliable liquid container simple in structure with a high storage efficiency is provided, which is capable of supplying ink outside at a stable negative pressure and free from the inconvenience even if it is used after the long term non-used state while storing the pigment ink. Also, a printer using this liquid container is provided. In this regard, while the settling phenomenon of the pigment dispersion is taken up as a problem in the above description and without limitation, further it is object of the present invention to provide means for obtaining an equal effect with respect to any of various materials dispersed in the printing liquid used for the ink-jet printer.

To achieve the above-mentioned objects, according to the present invention, a liquid container is provided, comprising a chamber for accommodating a negative pressure generating member capable of absorbing and retaining liquid, having a liquid supply port for supplying the liquid to an ink-jet printing head and an atmospheric communicating port communicating with outside air; and a liquid storage chamber for storing the liquid, having a first communication opening communicating with the chamber for accommodating the negative pressure generating member; the liquid in the liquid storage chamber being supplied to the printing head from the liquid supply port via the first communication opening through the negative pressure generating member in the chamber for accommodating the negative pressure generating member; wherein the liquid storage chamber is provided with a partition wall having a second communication opening through which the liquid flows therein before the liquid flows into the first communication opening, and the second communication opening of the partition wall includes a plurality of communication openings, each having a different height from a bottom end of the partition wall.

In this structure, when the liquid is supplied in response to the gas-liquid exchange operation from the liquid storage chamber to the chamber for accommodating a negative pressure generating member, the liquid passing through the second communication opening is supplied to the negative pressure generating member via the first communication opening with the concentration distribution of the liquid relieving the liquid having a concentration suitable for printing is supplied to a printing head from a supply port to be able to print optimally.

According to the present invention, the partition wall may extend close to a top surface of the liquid storage chamber.

Further, the liquid storage chamber may be provided with a duct having a second communication opening through which the liquid flows therein before the liquid flows into a first communication opening, and one end of the duct is connected to the first communication opening and the other end thereof opens to the upper portion of the liquid storage chamber.

According to the present invention, the second communication opening may comprise a plurality of communication openings, each having a different distance from a connection with a first communication opening disposed at one end of a duct.

Also, one end of the duct may be connected to part of the first communication opening and the other end thereof opens to the upper portion of the liquid storage chamber.

One end of the duct may be connected with a lower part of the first communication opening, and an upper part of the first communication opening is adapted to directly supply the liquid stored in the liquid storage chamber into the chamber for accommodating the negative pressure generating member.

According to the present invention, when the liquid is supplied to the chamber for accommodating the negative pressure generating member from the liquid storage chamber, the liquid passing through the second communication opening is supplied to the negative pressure generating member in response to the gas-liquid exchange operation via the first communication opening with the concentration distribution of the liquid relieving. The liquid having a concentration suitable for printing is supplied to a printing head from a supply port to be able to print optimally.

A liquid container comprising: a chamber for accommodating a negative pressure generating member capable of absorbing and retaining liquid, having an liquid supply port for supplying the liquid to an ink-jet printing head and an atmospheric communicating port communicating with outside air; a liquid storage chamber for storing the liquid, having a wall surface common to the chamber for accommodating the negative pressure generating member; and an intermediate chamber communicating with the chamber for accommodating the negative pressure generating member and with the liquid storage chamber; wherein the intermediate chamber further comprises a wall surface contiguous to the common wall surface and is convexly protruded from a lower portion of the chamber for accommodating the negative pressure generating member toward a lower portion of the liquid storage chamber; the contiguous wall surface having a plurality of through-holes. Even if a concentration distribution of the settled pigment colorant is distributed in low, proper and high concentration areas from the upper portion to the bottom of the chamber by the settling phenomenon after the liquid has not been supplied outside for a long period, the ink moves to the intermediate chamber while being well-concentration balanced by the gas-liquid exchange operation, whereby the high concentration ink is controlled to be a proper concentration and the liquid can be supplied outside via the negative pressure generating member after regulating a concentration.

Also, since the agitation and mixing of the ink portions having different concentrations are facilitated, which ink portions flow into the intermediate chamber through the plurality of holes by air introduced due to the gas-liquid exchange, it is possible to further enhance the uniformity of the ink concentration.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 10A:
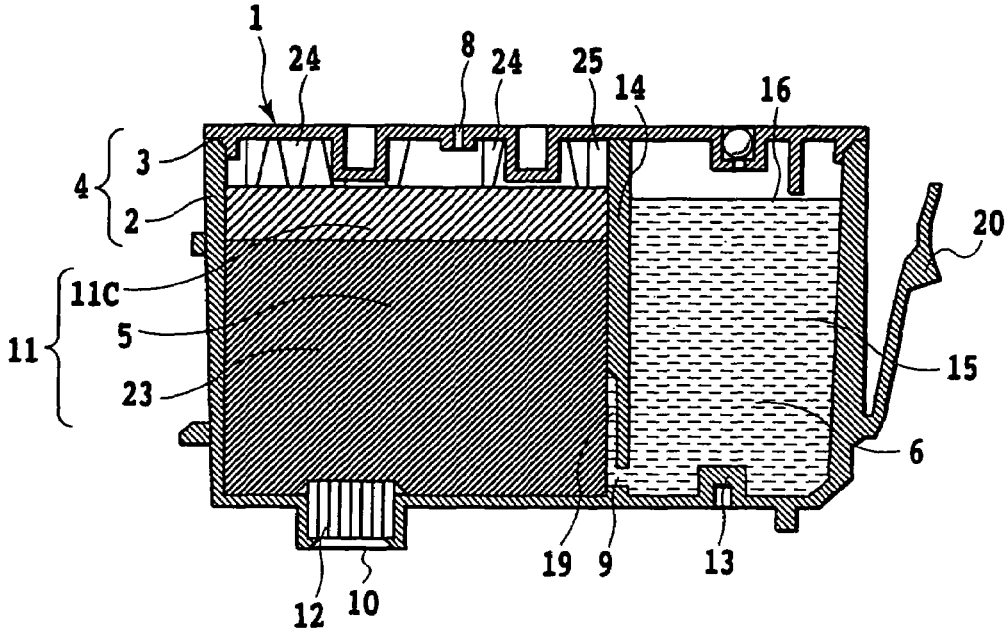
FIGS. 10A and 10B are explanation drawings for illustrating the prior art liquid container, respectively.

The preferred embodiments of the present invention will be described below with reference to the attached drawings wherein the same reference numerals as in FIG. 10 are used for indicating the same constituent elements and the description thereof is eliminated.

First Embodiment (Total Structure)

Figure 1:
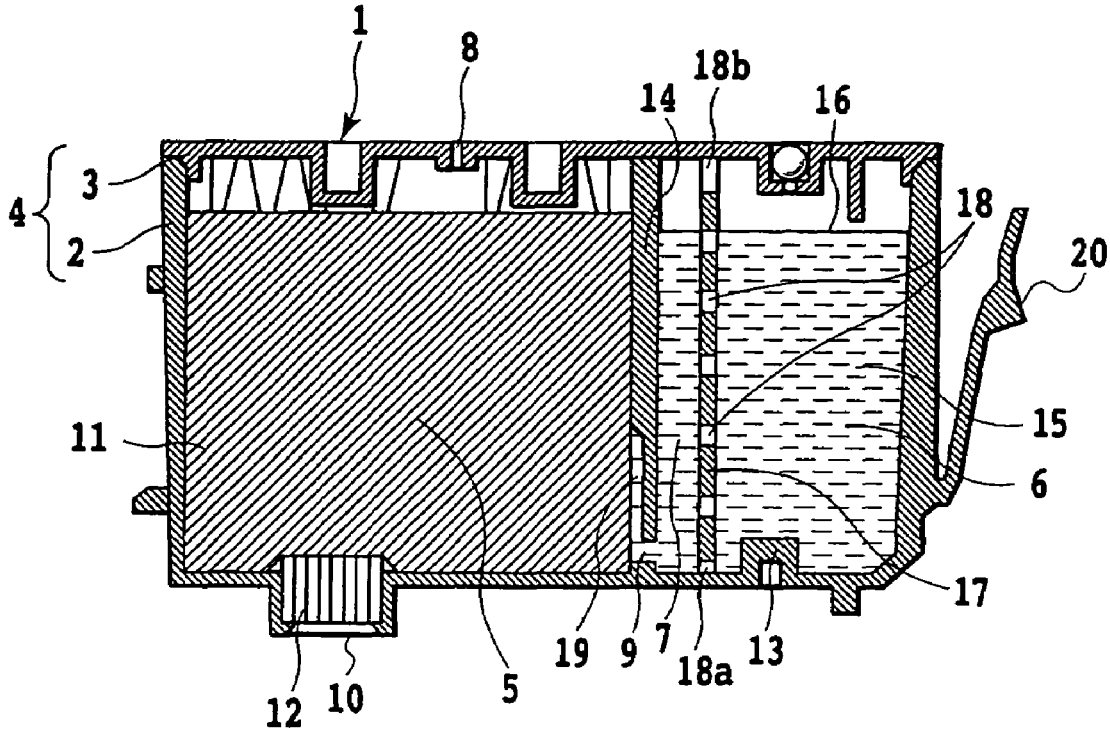
FIG. 1 is a schematic sectional view illustrating a liquid container according to a first embodiment of the present invention.

FIG. 1 is a schematic sectional view illustrating a liquid container according to an embodiment of the present invention. The liquid container 1 includes a housing 4 consisting of a tub 2 and a cover 3 made of synthetic resin and the interior thereof is divided into two spaces by a partition wall 14 having a communicating portion 9. One of the spaces defines a liquid storage chamber 6 closed except for the communicating portion 9 in the partition wall 14, for directly storing an ink 15. Other of the spaces defines a chamber 5 for accommodating a negative pressure generating member 11 impregnated with liquid. The ink 15 is a pigment ink.

On the upper portion of a wall defining the chamber 5 for accommodating the negative pressure generating member, there is an atmospheric communicating port 8 for introducing outside air into the liquid container 1 as the ink is consumed. On a wall surface of a lower wall opposite to the wall in which the atmospheric communicating port 8 is formed, an ink supply port 10 is formed while interposing the negative pressure generating member 11, for supplying the liquid to a printing head (not shown) via the ink delivery member 12.

In the interior of the liquid storage chamber 6, a thin partition wall 17 extends upward from the bottom thereof to define an intermediate chamber 7 interposed between the chamber 5 for accommodating the negative pressure generating member and the liquid storage chamber 6 for accommodating directly ink. In the partition wall 17, a plurality of communication holes 18 having a sufficiently small area relative to surfaces of the intermediate chamber 7 and the liquid storage chamber 6 opposite thereto are discretely provided from the vicinity of the bottom thereof in the upper direction. While the partition wall 17 may extend to the upper surface of the liquid storage chamber, it extends to a position not reaching the upper surface thereof in this embodiment to form an opening 18*b* in the upper region so that air in the intermediate chamber 7 is freely interchanged from outside air. Further, a position of the partition wall 17 is determined so that the intermediate chamber 7 becomes sufficiently small relative to the volume of the liquid storage chamber 6, or area of the bottom surface of the liquid storage chamber 6.

Figure 2:
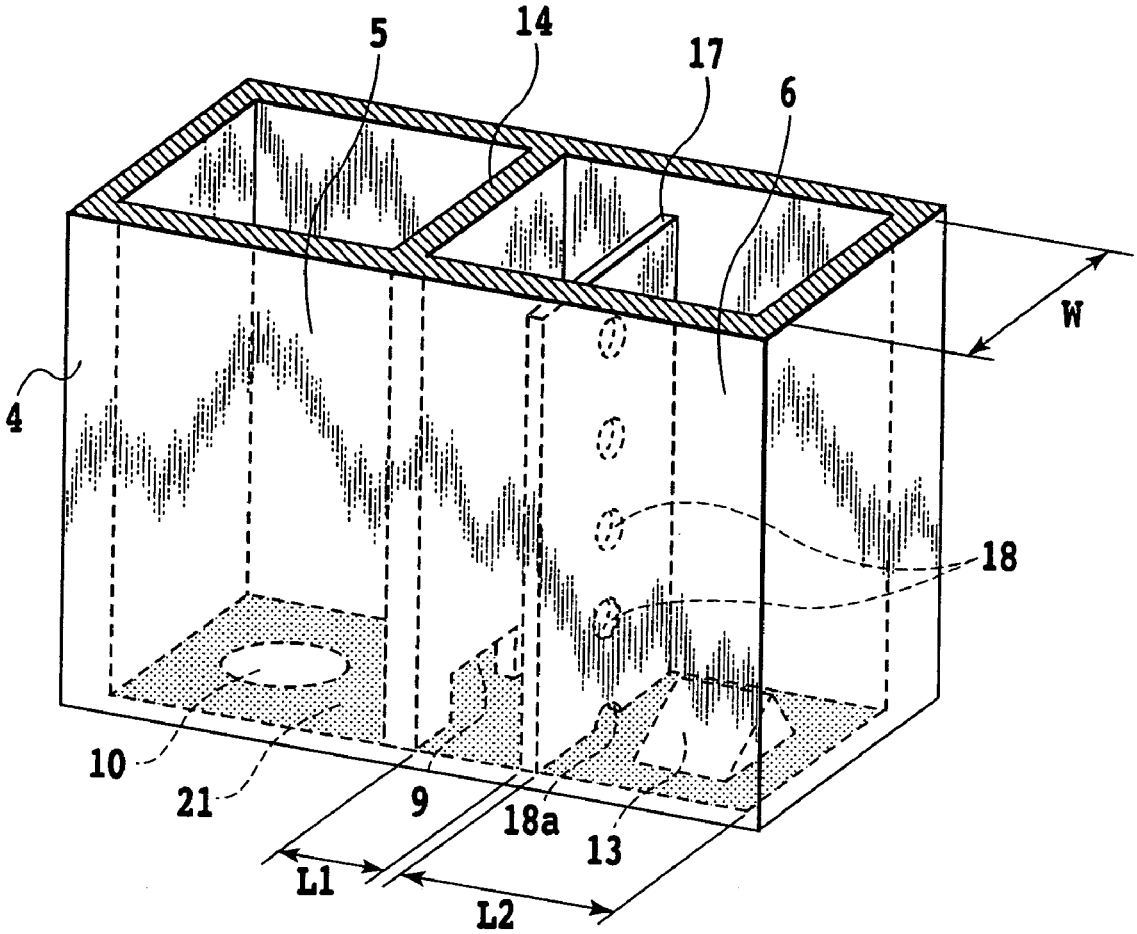
FIG. 2 is a perspective view of the liquid container shown in FIG. 1.

FIG. 2 is a perspective view of the liquid container shown in FIG. 1 wherein the negative pressure generating member 11, the ink 15 and the cover 3 are not shown. The above-mentioned description will be repeated with reference to FIG. 2. When an interior width W of the liquid container is generally constant and the arrangement of the chamber 5 for accommodating the negative pressure generating member, the intermediate chamber 7 and the liquid storage chamber 6 is in the longitudinal direction as shown in the drawing, the following relationship is given:

(A length L1 of the bottom surface of the intermediate chamber 7 perpendicular to the width W)<(a length L2 of the bottom surface of the liquid storage chamber 6 perpendicular to the width W)

(Long Term Non-Used State)

Figure 10B:
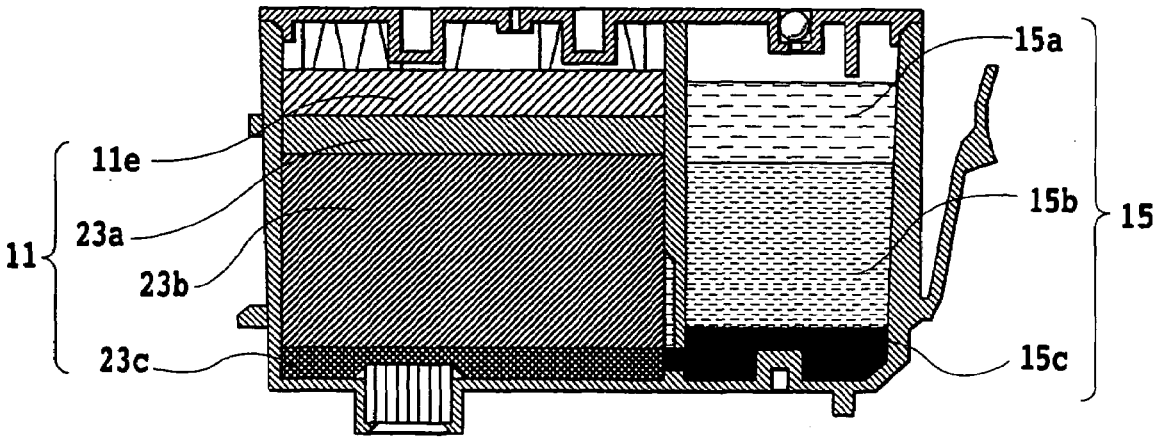
Figure 11:
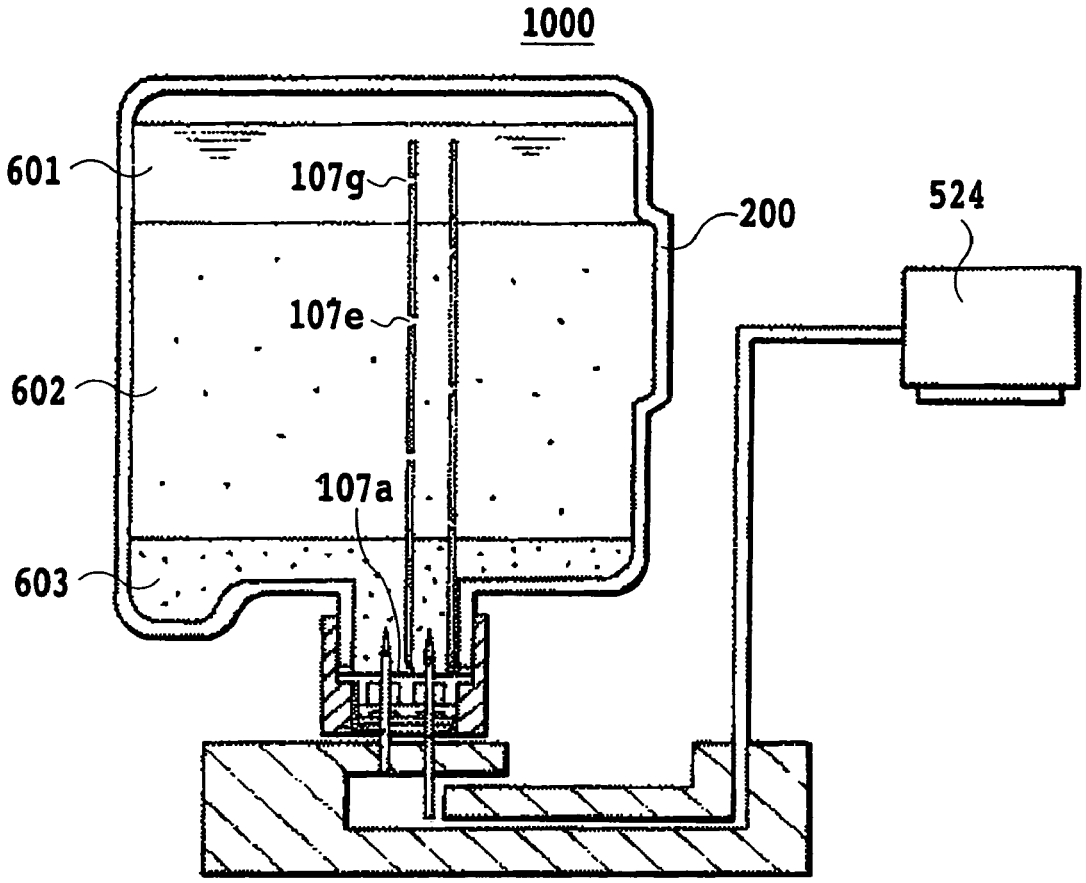
PRIOR ART FIG.11
FIG. 11 is explanation drawings for illustrating the prior art liquid container retaining directly liquid in the liquid container.
Figure 12:
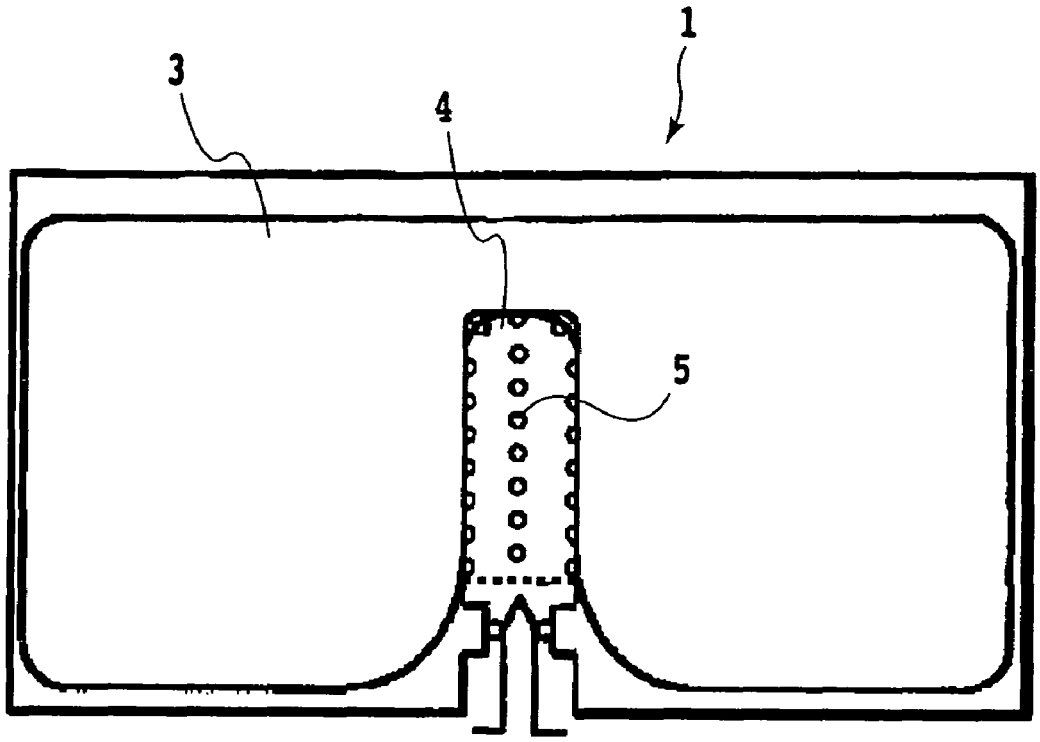
PRIOR ART FIG.12
FIG. 12 is explanation drawings for illustrating the prior art liquid container accommodating a negative pressure generating member in the liquid container.

Since no ink is supplied outside from the liquid container 1 and the liquid container 1 stands still on the printer when the container is in a long term non-used state, the state of pigment colorant settling stimulating such as described with reference to FIG. 10B illustrating the prior art is gradually reached.

However, since a volume of the intermediate chamber 7 is sufficiently smaller than that of the liquid storage chamber 6, a volume of the high concentration area 15*c* generated in the intermediate chamber 7 is extremely small.

(Ink Supplying State Thereafter)

The description will be made when the ink is supplied outside after the long term non-used state. In this regard, the outside ink supply from the liquid container is not limited to the supply to the printing head for the printing operation but includes ink delivery in response to the purging operation for maintaining the printer in a proper state.

In the liquid container 1 as shown in FIG. 1, the ink in the intermediate chamber 7 and the liquid storage chamber 6 is not consumed until ink in the negative pressure generating member 11 has been consumed by the printing head not shown (a first stage), whereby the liquid surface in the negative pressure generating member lowers to reach the upper end of the gas-liquid exchange groove 19 called as a groove.

On a third stage wherein the ink in the liquid storage chamber 6 has been completely consumed, similarly, ink in the intermediate chamber 7 and the liquid storage chamber 6 is not consumed. A second stage will be described below, which continues from an instant at which the ink reaches the upper end of the gas-liquid exchange groove 19 called as a groove to the beginning of the third stage.

Regarding the second stage, when the ink reaches the upper end of the gas-liquid exchange groove 19, outside air is introduced into the chamber 5 for accommodating the negative pressure generating member from the atmospheric communicating port 8 as the ink has been consumed thereafter, and enters the intermediate chamber 7 through the communicating portion 9 of the partition wall 14. Since the upper portion of the intermediate chamber 7 is communicated with the liquid storage chamber 6, the introduced outside air can freely pass between both the chambers. Instead of the introduced outside air, ink in the liquid storage chamber 6 transfers to the intermediate chamber 7 via the plurality of communication holes 18 including a communication hole 18*a* provided in the vicinity of the bottom, and fills the negative pressure generating member 11 in the chamber 5 through the communicating portion 9 of the partition wall 14 (hereinafter, this operation is referred to as a gas-liquid exchanging operation). Accordingly, even if the ink has been consumed by the printing head, the ink is filled to the negative pressure generating member 11 in accordance with amounts of the consumed ink. Thus, the negative pressure generating member 11 always holds a constant amount of ink and maintains a generally constant negative pressure relative to the printing head to stabilize the ink supply to the printing head.

Now the detailed description will follow. Suppose that the liquid container has been left on the first stage for a long period and then transferred to the second stage at the beginning of the use, or it has been left on the second stage for a long period and then continues this stage at the beginning of the use. Since the partition wall 17 is provided, upon transferring ink from the liquid chamber 6 to the chamber 5 for accommodating the negative pressure generating member, ink portions distributed in the height direction of the liquid container in the areas of a low ink concentration, a proper ink concentration and a high ink concentration are collected via the plurality of communication holes 18 including communication hole 18*a* in the vicinity of the bottom of the container, provided at different heights of the liquid container, and ink portions can be transferred into the negative pressure generating member 11. Accordingly, even if the pigment colorant settles toward the bottom, the respective ink portions in the areas of a low ink concentration, a proper ink concentration and a high ink concentration can be caught, whereby this is effective as a countermeasure against the settling of the pigment colorant as the pigment colorant is agitated by air introduced into the liquid storage chamber from atmospheric communicating port via the chamber for accommodating the negative pressure generating member due to the gas-liquid exchange operation.

A hole diameter, a hole pitch and a hole arrangement of the plurality of communicating holes 18 may be suitably selectable so that the effect is maintained even if the ink surface in the liquid container is lowered.

Also, the plurality of communication holes are operable to approximately equalize the height of the liquid surface so that the respective ink portions distributed in the low, proper and high concentration areas are collected irrespective of the height of the liquid surface and fed into the intermediate chamber 7. In other words, the communication holes 18 are provided so that the liquid surfaces of the intermediate chamber 7 and the liquid storage chamber 6 become approximately flush with each other when the liquid is supplied outside from the ink supply port 10.

In such a manner, the ink transferred into the negative pressure generating member 11 by the gas-liquid exchanging operation (the second stage operation) is supplied to the printing head via the ink delivery member 12 after being adjusted to an approximately proper concentration (a first effect).

In this regard, it is important that the position of the partition wall 17 on the bottom of the intermediate chamber 7 is determined not to increase the volume of the high concentration area, and preferably to form a space not to interfere with the rise of air bubbles introduced from the chamber 5 for accommodating the negative pressure generating member into the intermediate chamber 7 during the gas-liquid exchanging operation. In such a structure, the ink caught from the respective communicating portion 18 forms a counterflow relative to the rising air bubbles resulting in a sufficient mixing effect within the intermediate chamber 7, which is a second effect of the present invention.

Figure 3A:
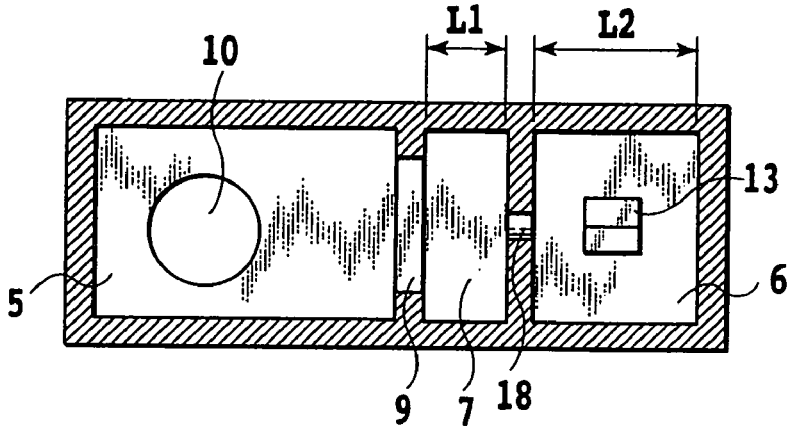
FIGS. 3A and 3B are explanation drawings for illustrating the relationship between a reflection prism and an intermediate chamber relating to FIGS. 1 and 2, respectively.
Figure 3B:
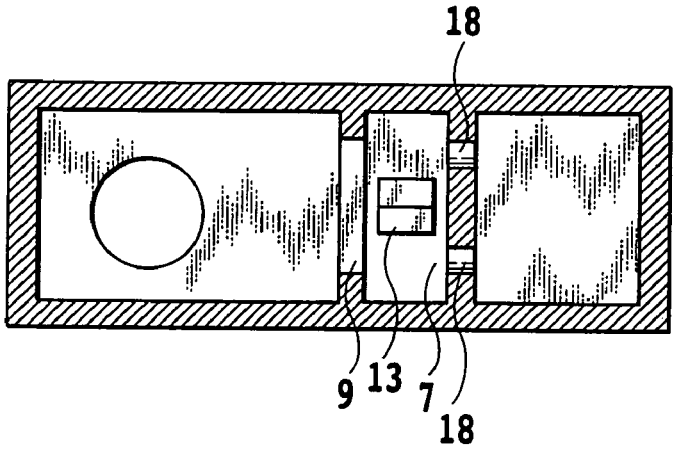

FIG. 3A is a schematic sectional view of the embodiment shown in FIGS. 1 and 2 as seen from above. On the bottom of the liquid storage chamber 6, a refection prism 13 is provided, if necessary, for detecting whether or not the ink exists in the liquid storage chamber 6 and the intermediate chamber 7. This prism 13 may be provided in the intermediate chamber 7 as shown in FIG. 3B.

Further, a modification of the first embodiment will be described below.

Figure 4:
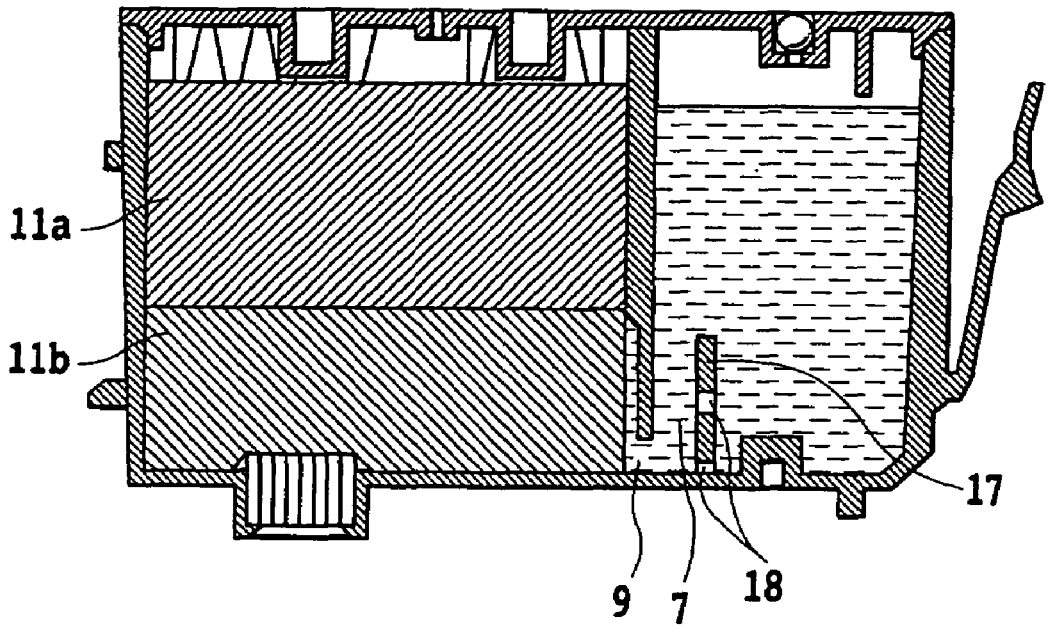
FIG. 4 is a schematic sectional view illustrating a modification of a first embodiment according to the present invention.

The modification shown in FIG. 4 is different from the preceding embodiment in that the partition wall 17 extending upward from the bottom of the liquid storage chamber 6 is relatively low. Even in this structure, the problems in the prior art can be similarly solved because the collection of ink from the high concentration area and the proper concentration area and the mixing effect are obtained, which have been particularly problematic in view of the quality of the printed image and the reliability of the printing head. Also, the negative pressure generating member may be of a laminated structure consisting of a member 11*a* having a relatively weak capillary action and a member 11*b* having a relatively strong capillary action.

Figure 5:
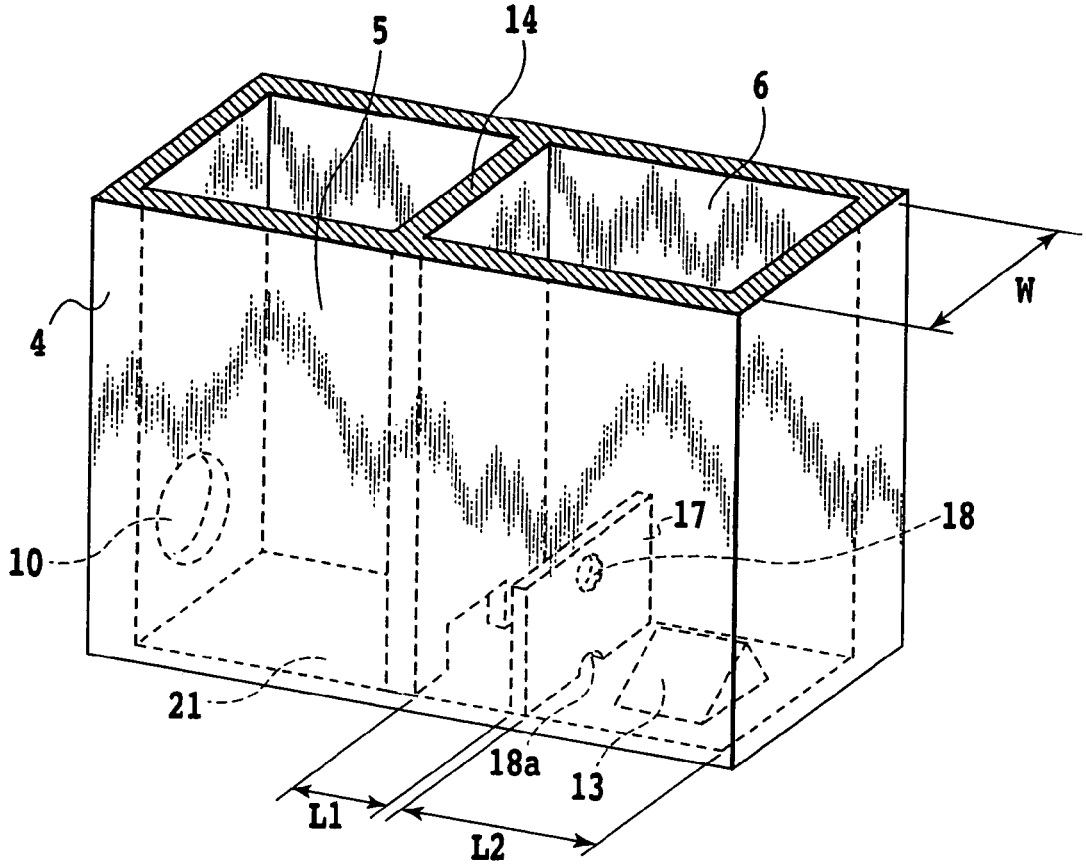
FIG. 5 is a perspective view related to the liquid container shown in FIG. 4.

FIG. 5 is a schematic perspective view of the liquid container corresponding to that shown in FIG. 4, wherein a position of the ink supply port 10 is different; that is, the port 10 is provided not on the bottom surface 21 but on a lateral surface vertical to the bottom surface 21 and opposite to the partition wall 14. This structure has the effect inherent to the present invention. Also, the structure shown in FIG. 4 or 5 is capable of minimizing a loss of the liquid storage space in the liquid storage chamber due to the partition wall.

Second Embodiment

A second embodiment of the present invention will be described with reference to FIG. 6.

Different from the structure shown in FIG. 1 wherein the partition wall 17 having the plurality of communication holes 18 is provided, the chamber 5 for accommodating the negative pressure generating member is communicated with the liquid storage chamber 5 through a duct 27 extending upward from the vicinity of the bottom of the liquid storage chamber 6 while coupled to the communicating portion 9. That is, the intermediate chamber 7 in FIG. 1 corresponds to the interior space in the duct 27, and the communication holes 18 provided in the partition wall 17 correspond to a plurality of through-holes provided on the lateral wall of the duct.

Figure 7A:
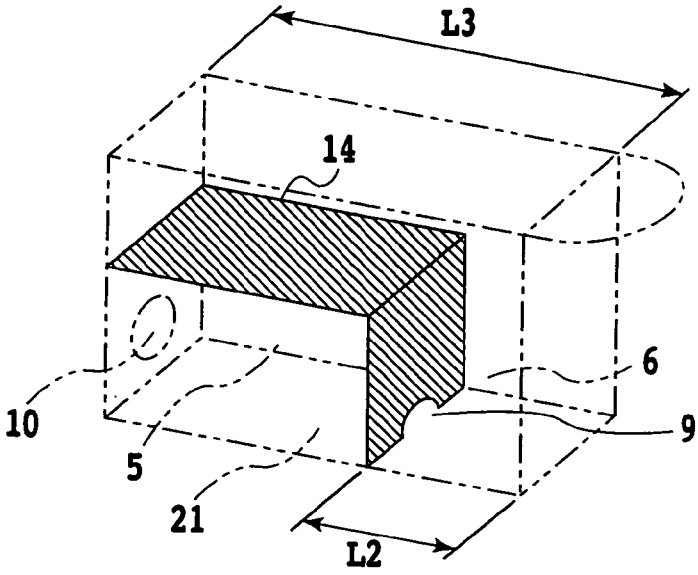
FIGS. 7A, 7B, and 7C are perspective views, respectively, illustrating a modification of the second embodiment according to the present invention.
Figure 7B:
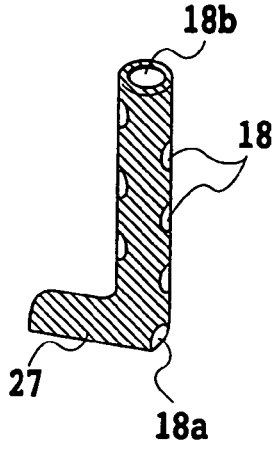
Figure 7C:
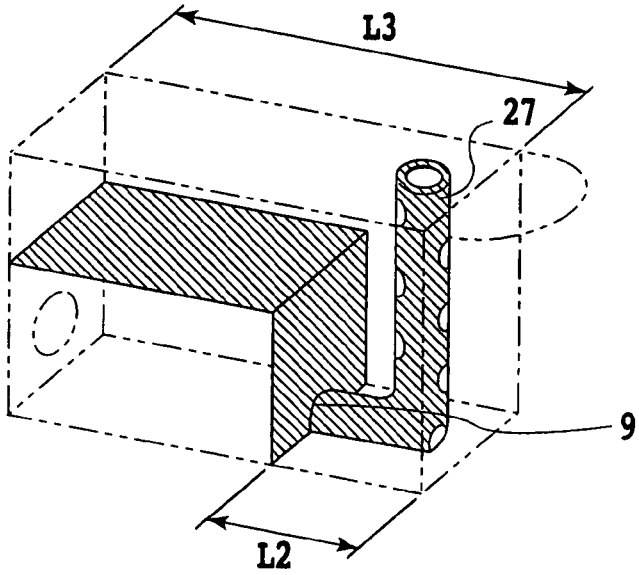

FIG. 7 illustrates a modification of the second embodiment wherein the present invention is applied to a prior art liquid container different from that shown in FIG. 10. FIG. 7A is a schematic view of the inventive liquid container before a duct 27 shown in FIG. 7B is incorporated, and FIG. 7C shows a state wherein the duct 27 of FIG. 7B is incorporated. In the liquid container shown in FIG. 7A, the partition wall 14 does not extend from the bottom of the housing to the upper wall thereof but bends midway in the lateral direction so that the liquid storage chamber 6 is formed not only on the lateral side of the chamber 5 for accommodating the negative pressure generating member but also on the upper side thereof. In the tank of such a structure, the duct 27 is incorporated into the communicating portion 9.

The effect of the present invention is similarly obtainable by the structure shown in FIG. 6 or FIGS. 7A to 7C. In this regard, The extended length of the duct 27 may be shorter as in the relationship between FIGS. 1 and 4. Even in such a case, of course, it goes without saying that the first and second effects of the present invention are still obtainable.

A further modification will be described below.

Figure 6:
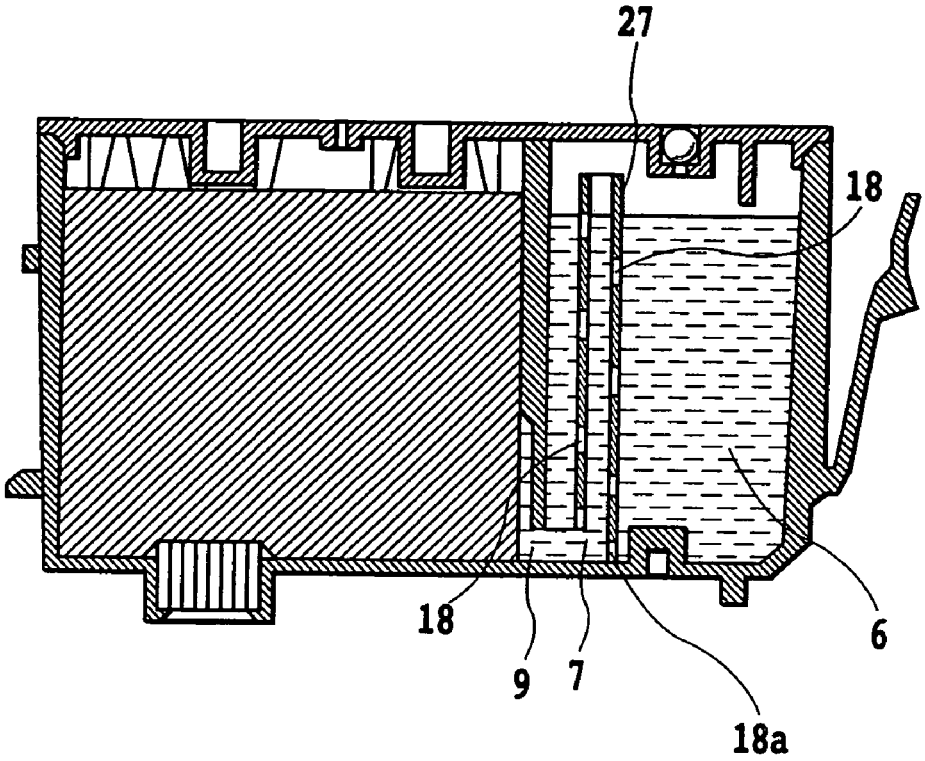
FIG. 6 is a schematic sectional view illustrating a liquid container according to a second embodiment of the present invention.
Figure 8:
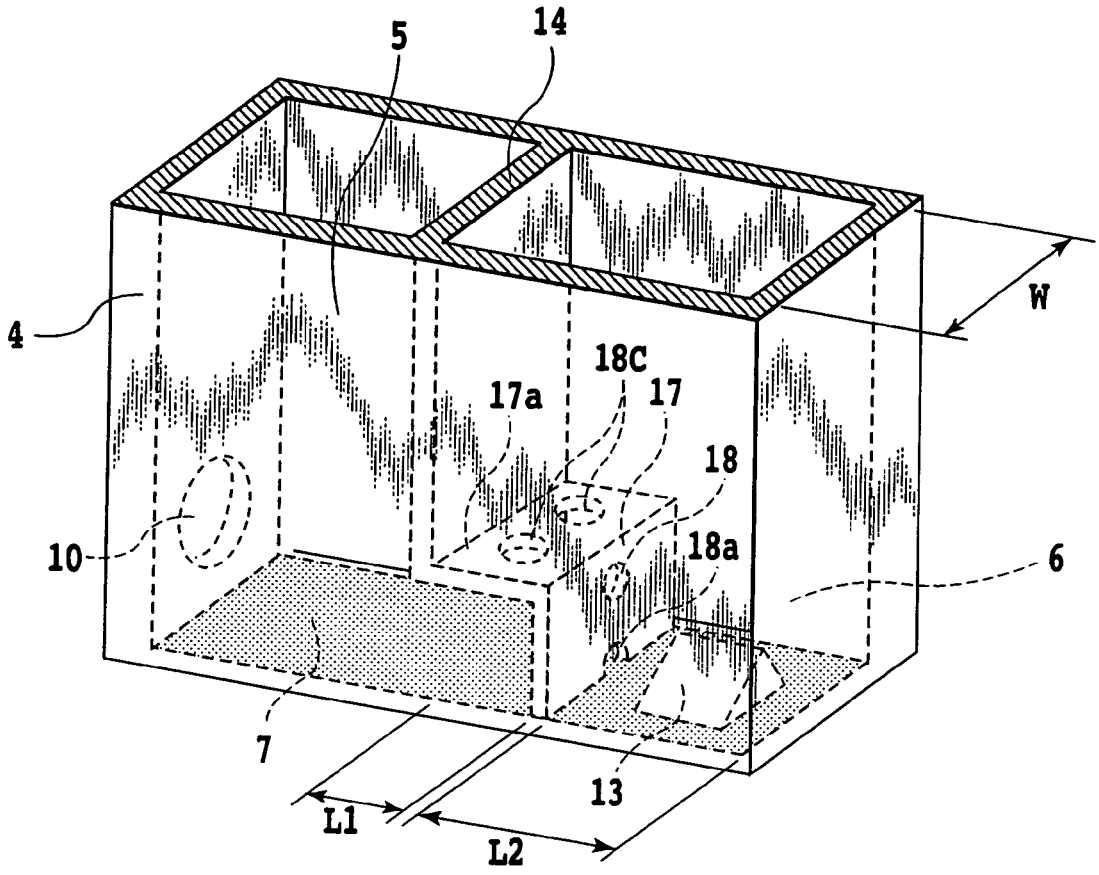
FIG. 8 is a perspective view illustrating another modification of the second embodiment according to the present invention.

FIG. 8 illustrates another modification of the second embodiment, wherein the duct FIG. 6 becomes shorter to be a structure similar to the partition wall shown in FIG. 4. In other words, the intermediate chamber 7 is formed by connecting the upper end of the partition wall 17 to the partition wall 14 in the liquid container shown in FIG. 4 by means of a wall 17*a* having through-holes 18*c*. In this case, the gas-liquid exchange groove 19 shown in FIG. 4 is not provided and, instead, the communicating portion 9 extends to a height corresponding to the upper end of the gas-liquid exchange groove 19. Also, the effects of the present invention is similarly obtainable by this structure.

Third Embodiment

Figure 9:
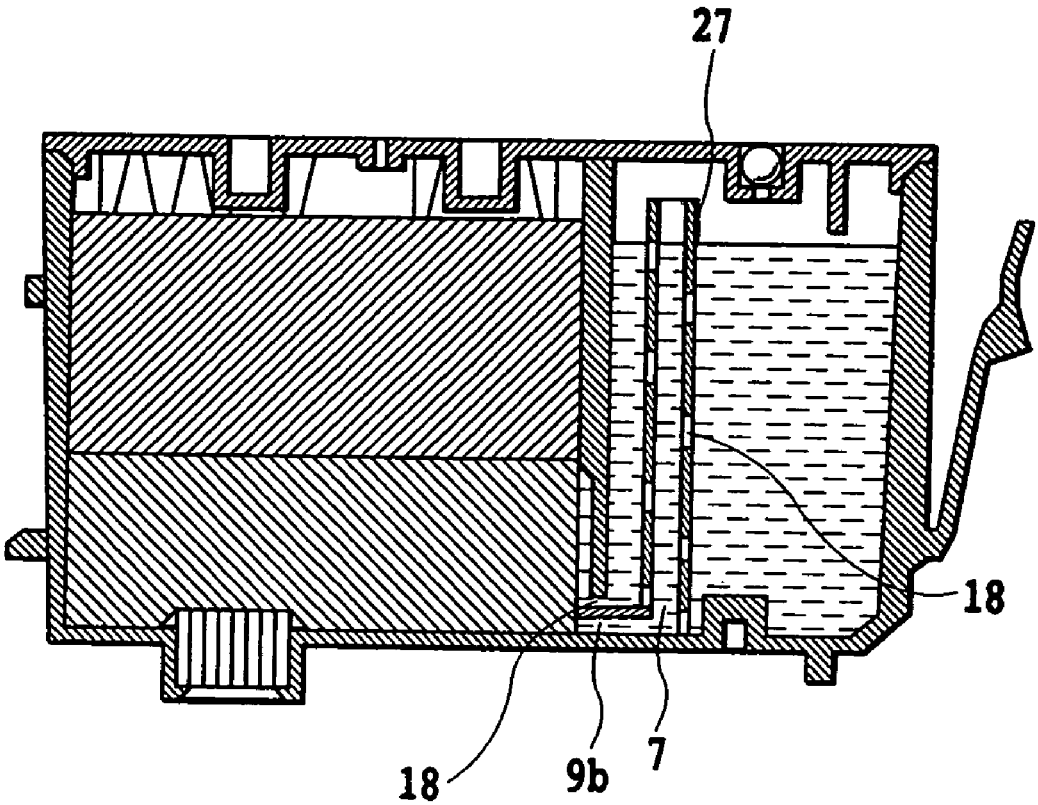
FIG. 9 is a schematic sectional view illustrating a liquid container according to a third embodiment of the present invention.

Subsequently, a third embodiment will be described below. A structure shown in FIG. 9 is different in the construction of the communicating portion 9 from that of FIG. 6; i.e., the communicating portion 9 is divided into an upper region 9*a* and a lower region 9*b*. The upper region 9*a* of the communicating portion 9 directly communicates with the liquid storage chamber 6 to be a route for sending outside air from the chamber 5 for accommodating the negative pressure generating member into the liquid storage chamber 6. On the other hand, the lower region 9*b* of the communicating portion 9 communicates with the duct 27 and with the liquid storage chamber 6 via the through-holes 18 in the tubular wall thereof. Of course, in this structure, it goes without saying that the first effect of the present invention is obtainable. In this embodiment (see FIG. 9), different from the second embodiment (see FIG. 6), air obtained by the gas-liquid exchange is not taken into an interior space within a pipe regarded as the intermediate chamber. However, the agitation effect (the second effect) due to the rising air bubbles in the liquid storage chamber is also obtainable.

The first, second and third embodiments have been described above. Since various spaces exist in the liquid storage chamber caused by the partition wall, the intermediate chamber or the duct, it is preferable to fill the liquid storage chamber including these spaces with the liquid so that no air remains therein during the manufacture thereof. This is because of the avoidance of the inconvenience due to the expansion/contraction of air existing in the liquid storage chamber constituting the substantially closed space except for the communicating portion communicating with chamber for accommodating the negative pressure generating member, in accordance with the change of the environmental condition (such as an atmospheric pressure or an air temperature) before the produced ink tank has been received by the user. In view of a total storage efficiency of the ink tank, it is preferable that the chamber for accommodating the negative pressure generating member is also fully filled with ink. In this regard, it will be understood from the above description that the effects of the present invention are not resulted from a total size of the liquid container, a ratio between a horizontal length, a lateral length and a height thereof, a ratio in volume between the chamber for accommodating the negative pressure generating member and the liquid storage chamber, the relationship between the arrangement of both the chambers and the scanning direction of the liquid container or others.

The liquid container described hereinabove is used for a serial scanning type printer while detachably mounted on a carriage having an ink-jet printing head to be movable in the widthwise direction of a printing paper.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Application No. 2004-164548 filed Jun. 2, 2004, which is hereby incorporated by reference herein.

What is claimed is:

1. A liquid container comprising:

a chamber for accommodating a negative pressure generating member capable of absorbing and retaining liquid, having a liquid supply port for supplying the liquid to an ink-jet printing head and an atmospheric communicating port communicating with outside air; and a liquid storage chamber for storing the liquid, having a first communication opening communicating with said chamber;

said liquid in said liquid storage chamber being supplied to the printing head from said liquid supply port via said first communication opening through said negative pressure generating member in said chamber;

wherein said liquid storage chamber is provided with a partition wall having a second communication opening through which the liquid flows therein before the liquid flows into the first communication opening, and said second communication opening of said partition wall includes a plurality of communication openings, each having a different height from an end of said partition wall.

2. A liquid container as claimed in claim 1, wherein said partition wall extends close to a top surface of said liquid storage chamber.

3. A liquid container as claimed in claim 1, wherein said liquid contains insoluble dispersant.

4. An ink-jet printing apparatus on which is detachably mounted said liquid container as claimed in claim 1.

5. A liquid container comprising:

a chamber for accommodating a negative pressure generating member capable of absorbing and retaining liquid, having a liquid supply port for supplying the liquid to an ink-jet printing head and an atmospheric communicating port communicating with outside air; and a liquid storage chamber for storing the liquid, having a first communication opening communicating with said chamber;

said liquid in said liquid storage chamber being supplied to the printing head from said liquid supply port via said first communication opening through said negative pressure generating member in said chamber, wherein the liquid storage chamber is provided with a duct having a second communication opening through which the liquid flows therein before the liquid flows into the first communication opening, and one end of said duct is connected to said first communication opening and the other end thereof opens to the upper portion of said liquid storage chamber.

6. A liquid container as claimed in claim 5, wherein said second communication opening comprises a plurality of communication openings, each having a different distance from a connection with said first communication opening disposed at one end of said duct.

7. A liquid container as claimed in claim 5, wherein one end of said duct is connected with a lower part of said first communication opening, and an upper part of said first communication opening is adapted to directly supply the liquid stored in said liquid storage chamber into said chamber for accommodating the negative pressure generating member.

8. A liquid container comprising:

a chamber for accommodating a negative pressure generating member capable of absorbing and retaining liquid, having an liquid supply port for supplying the liquid to an ink-jet printing head and an atmospheric communicating port communicating with outside air;

a liquid storage chamber for storing the liquid, having a wall surface common to said chamber; and an intermediate chamber communicating with said chamber and with said liquid storage chamber;

wherein said intermediate chamber further includes a wall surface contiguous to said common wall surface and is convexly protruded from a lower portion of said chamber for accommodating the negative pressure generating member toward a lower portion of said liquid storage chamber; said contiguous wall surface having a plurality of through-holes.

* * * * *